United States Patent [19]

Gilreath

[11] 4,049,948

[45] Sept. 20, 1977

[54] OVEN HAVING AN ELECTRIC HEATING ELEMENT WITH A HINGED SUPPORT

[75] Inventor: Robert V. Gilreath, Cookeville, Tenn.

[73] Assignee: Still-Man Mfg. Company, Cookeville, Tenn.

[21] Appl. No.: 686,277

[22] Filed: May 14, 1976

Related U.S. Application Data

[62] Division of Ser. No. 566,739, April 10, 1975, Pat. No. 3,984,003.

[51] Int. Cl.[2] ..... F27D 11/02

[52] U.S. Cl. ..... 219/404; 211/100; 219/403; 219/536; 248/70

[58] Field of Search ..... 219/402, 403, 404, 536; 211/100; 248/70, 291; 312/236, 251

[56] References Cited

U.S. PATENT DOCUMENTS

| | | | |
|---|---|---|---|
| 3,171,946 | 3/1965 | Ammerman | 219/404 |
| 3,334,215 | 8/1967 | Allen, Jr. | 219/404 |
| 3,838,841 | 10/1974 | Cadman | 248/293 X |
| 3,875,371 | 4/1975 | Skinner | 219/404 |
| 3,984,003 | 10/1976 | Gilreath | 211/100 |

FOREIGN PATENT DOCUMENTS

| | | | |
|---|---|---|---|
| 703,018 | 2/1965 | Canada | 219/404 |

*Primary Examiner*—Volodymyr Y. Mayewsky
*Attorney, Agent, or Firm*—Marn & Jangarathis

[57] ABSTRACT

A hinged or pivoted support for an oven heating element having one bracket attached to an oven surface and a second bracket, holding the heating element, pivotally supported by the first bracket. The first bracket includes resilient clips, which cooperate with the second bracket to retain the second bracket and heating element in a tilted position.

3 Claims, 5 Drawing Figures

FIG. 1
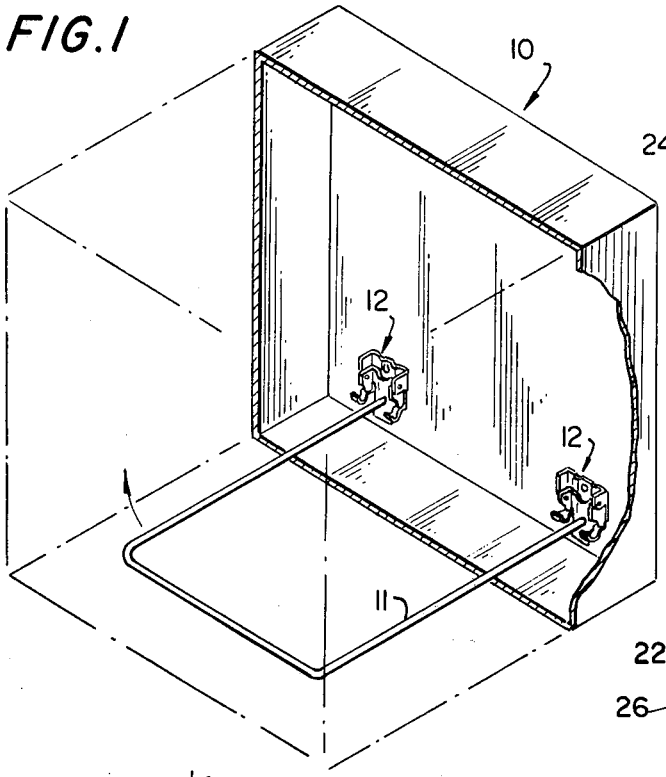
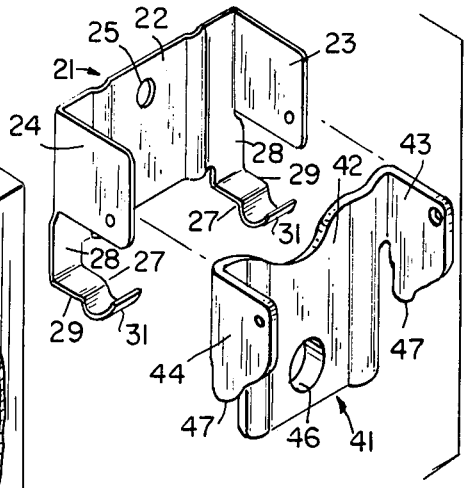
FIG. 2
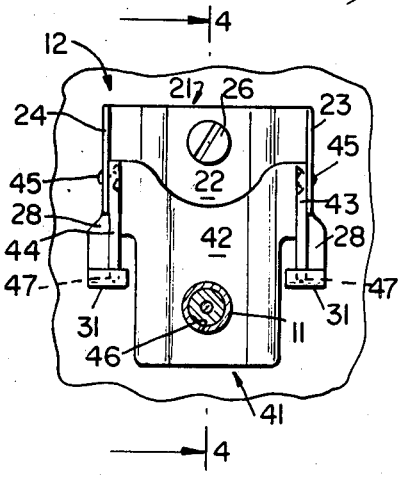
FIG. 3
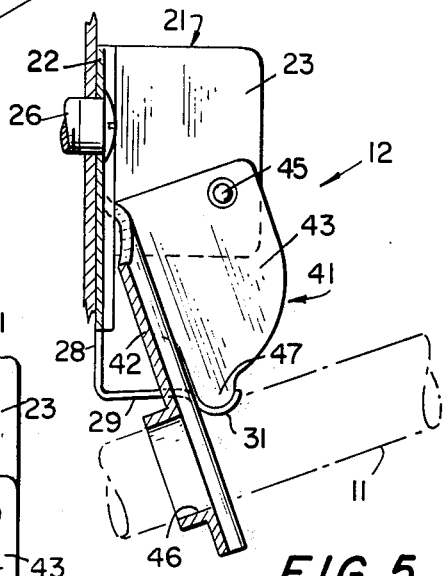
FIG. 5
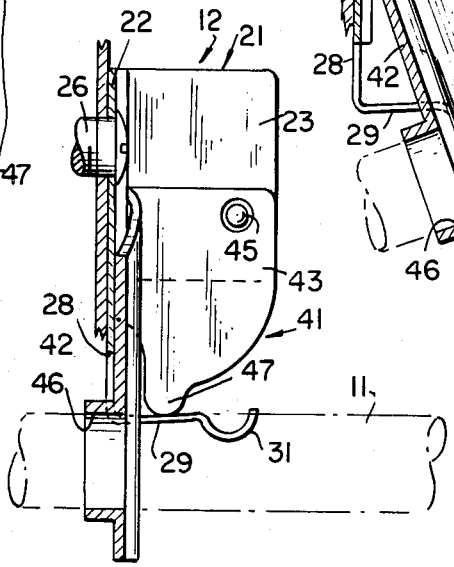
FIG. 4

OVEN HAVING AN ELECTRIC HEATING ELEMENT WITH A HINGED SUPPORT

This is a division of application Ser. No. 566,739, filed Apr. 10, 1975, now U.S. Pat. No. 3,984,003.

This invention relates to electric heaters and more particularly to electric ovens. This invention further relates to a new and improved pivoted support which is particularly suited for supporting an electric heating element.

In electric ovens there is a need for a support for the electric heating element which permits movement of the element from a horizontal position to a tilted or elevated position to facilitate cleaning of the oven.

Thus, in a self cleaning oven, the electric heating element is moved to a tilted or elevated position, followed by closing of the oven door and switching to the clean cycle. In this cycle, the temperature is raised to approximately 900° F and maintained at this temperature for a period of time sufficient to effect cleaning of the oven. To date, the brackets or supports for the oven heating elements have not been capable of maintaining the electric heating element in the elevated position during the cleaning cycle in continued use and, accordingly, there is a need for improved supports for oven heating elements.

An object of this invention is to provide a new and improved pivotal support.

A further object of the present invention is to provide a new and improved pivotal support for an electric heating element.

Another object of the present invention is to provide an electric heater having the heating element pivotally supported therein.

Still another object of the present invention is to provide an electric oven having the heating element pivotally supported therein.

These and other objects of the present invention should become apparent from reading the following description thereof.

In accordance with the present invention there is provided a support for pivotally supporting an article which includes a first bracket which is to be fastened to a supporting surface and a second bracket for supporting the article which is pivotally supported by the first bracket. The first bracket includes locking means which cooperates with means in the second bracket to releasably lock or hold the first bracket in a pivoted position. In accordance with a preferred embodiment, the locking means also defines the end limits for the pivotal movement of the second bracket.

In accordance with a preferred aspect of the present invention, the first bracket is fastened to an oven wall and the second bracket supports the electric heating element for the oven. The second bracket supports the heating element in a substantially horizontal position, and can be pivoted, on the second bracket, angularly upwardly, to a second position, wherein the second bracket and heating element are supported and maintained by the clips on the first bracket, in the tilted or elevated position, to permit cleaning of the oven. The clips releasably hold the second bracket, in the pivoted position, whereby the heating element and second bracket can be pivoted back to a horizontal position.

The invention will be further described with respect to an embodiment thereof illustrated in the accompanying drawings wherein:

FIG. 1 is a simplified schematic representation of an oven including an embodiment of the support of the present invention;

FIG. 2 is an exploded isometric view of an embodiment of the pivoted support of the present invention;

FIG. 3 is a front elevational view of the pivoted support of FIG. 2;

FIG. 4 is a sectional view taken on the line 4—4 of FIG. 3;

FIG. 5 is a sectional view with the support in a pivoted position.

Referring now to the drawings, an electric heater, in the form of an oven 10, includes an electric heating element 11, which is supported on the rear wall of the oven 10 by a pair of hinged pivotal supports 12 in accordance with the present invention.

The hinge support (FIGS. 2-5) for the heating element 11, formed of a suitable heat-resistant material, in particular a metal, includes first bracket 21, having a main body portion 22 and integral perpendicular side walls 23 and 24. The main body portion 22 is provided with an aperture 25 by which the first bracket 21 can be mounted by suitable means, such as a screw 26, to a support surface, such as the oven wall.

The main body portion 22 is provided with a locking means in the form of integral downwardly depending L-shaped resilient clips 27 including a vertical portion 28 and a horizontal portion 29. The outer extremity of the leg 29 of clips 27 is provided with a U-shaped holding portion 31 for retaining the heating element in a tilted position, as hereinafter described.

A second bracket 41 having a main body portion 42 and integral perpendicular side walls 43 and 44 is pivotally mounted to the first bracket 21 by a suitable pivotal connection, such as pins 45, connecting the side walls 43 and 44 of bracket 41 to the side walls 23 and 24 of bracket 21. The lower portion of the main body portion 42 of bracket 41 extends beyond the lower extremity of bracket 21 and includes means, such as aperture 46, for fixedly holding the heating element 11.

The side walls 43 and 44 of bracket 41 include means which are retained by the locking clips 27 in the form of projecting nose-like portions 47, which, when the brackets 21 and 22 are positioned in parallel vertical planes, are in engagement with the inner ends of legs 29 of clips 27. The projecting portions 47 maintain the resilient clips 27 in a flexed or expanded position; i.e., the legs 29 of clips 27 are forced downwardly by the projecting portions 47.

Upon angularly pivoting the bracket 41 away from the bracket 21, to position the heating element 11 in a tilted or elevated position, the projecting portions 47 slide along the legs 29 of clips 27 and enter the U-shaped portion 31 thereof, thereby releasing the downward force on the clips 27, and permitting the stored energy of the clips 27 to upwardly move the legs 29, thereby securing the projecting portions 47 in the U-shaped holding portions 29 of the clips 27 (See FIG. 5). The U-shaped portion 31 also functions as a stop or outer limit for the pivoting of the bracket 41 with respect to the bracket 21. In addition, the clips 27, as a result of the resilient properties thereof, counteract the downward force of the heating element 11, and securely hold the bracket 41 and heating element 11 in the pivoted or tilted position. The holding force, however, is not so great as to prevent exertion of an external force to return the bracket 41 to a vertical position, i.e., in a plane parallel to the bracket 21, to thereby return the heating element 11 to a horizontal position.

Although the present invention has been particularly described and has particular utility for pivotally or hingedly supporting an electric heating element in an oven, in particular a self-cleaning oven, it is to be understood that the invention is also applicable to supporting electric heating elements in other environments. Similarly, the support could be employed for hingedly or pivotally suporting an article other than an electric heating element.

Numerous modifications and variations of the present invention are possible in light of the above teachings and, therefore, within the scope of the appended claims the invention may be practised otherwise than as particularly described.

What is claimed is:

1. In combination with an oven, having an electric heating element, a first bracket attached to an interior wall of the oven; a second bracket supporting said electric heating element, said second bracket being pivotally connected to said first bracket for supporting and moving the heating element between a horizontal position and a tilted elevated position, said first bracket including at least one outwardly extending resilient leg portion, the outer portion of said resilient leg portion including a holding portion; said second bracket including at least one projecting portion in sliding engagement with said resilient leg portion, said projecting portion exerting a force to flex the resilient leg portion with the heating element in a horizontal position, and in moving the heating element to an elevated tilted position, said projecting portion sliding outwardly along said resilient leg portion and into the holding portion to release the flexing force on said resilient leg portion whereby the projecting portion is releasably latched in said holding portion to releasably maintain the heating element in the tilted position.

2. The combination of claim 1 wherein said first and second brackets each have a generally U-shape and include a main body portion and opposite side walls, each one of the side walls of the second bracket being pivotally mounted to a corresponding side wall of the first bracket, the main body portion of the second bracket extending beyond the main body portion of the first bracket, and the heating element being positioned in the portion of the main body portion of the second bracket which extends beyond the main body portion of the first bracket.

3. The combination of claim 2 wherein the first bracket includes a pair of opposed resilient leg portions in alignment with the side walls of the first bracket and the second bracket includes a pair of opposed projecting portions which project from the side walls of the second bracket each of which is in sliding engagement with one of the pair of resilient leg portions.

* * * * *